US009567738B2

(12) United States Patent
Schlueter

(10) Patent No.: US 9,567,738 B2
(45) Date of Patent: Feb. 14, 2017

(54) FLOOR DRAIN

(71) Applicant: Schluter Systems L.P., Plattsburgh, NY (US)

(72) Inventor: Werner Schlueter, Iserlohn (DE)

(73) Assignee: Schluter Systems L.P., Plattsburgh, NY (US)

( * ) Notice: Subject to any disclaimer, the term of this patent is extended or adjusted under 35 U.S.C. 154(b) by 0 days.

(21) Appl. No.: 14/809,590

(22) Filed: Jul. 27, 2015

(65) Prior Publication Data

US 2015/0330068 A1 Nov. 19, 2015

Related U.S. Application Data

(62) Division of application No. 12/932,301, filed on Feb. 23, 2011, now Pat. No. 9,127,446.

(30) Foreign Application Priority Data

Feb. 24, 2010 (DE) ..... 20 2010 002 763 U

(51) Int. Cl.
*E03F 5/04* (2006.01)
*E03F 5/06* (2006.01)

(52) U.S. Cl.
CPC ..... *E03F 5/04* (2013.01); *E03F 5/0408* (2013.01); *E03F 5/06* (2013.01); *E03F 2005/0413* (2013.01)

(58) Field of Classification Search
None
See application file for complete search history.

(56) References Cited

U.S. PATENT DOCUMENTS

| | | | |
|---|---|---|---|
| 1,406,068 | A | 2/1922 | Padgett |
| 2,419,996 | A | 5/1947 | Honikman |
| 2,436,593 | A | 2/1948 | Moselowitz |
| 2,701,027 | A | 2/1955 | Scoville |
| 2,749,999 | A | 6/1956 | Schmid |

(Continued)

FOREIGN PATENT DOCUMENTS

| | | |
|---|---|---|
| DE | 100 56 130 A1 | 7/2002 |
| DE | 20 2006 002 077 U1 | 6/2007 |

(Continued)

OTHER PUBLICATIONS

German Search Report dated Dec. 14, 2010 in German Application No. 20 2010 002 763.2 with English translation of relevant parts.

(Continued)

*Primary Examiner* — Robert Popovics
(74) *Attorney, Agent, or Firm* — Thorpe North & Western

(57) ABSTRACT

A floor drain (10; 60; 70) comprising a channel body (14; 90) defining a drain channel (24) and having a drain opening (26), a frame (16; 62) defining a receiving opening (32) which can be inserted at least partially into the drain channel (24) and a cover (18) that can be inserted into the receiving opening (32) of the frame (16; 62), in particular in the form of a grate, at least one spacer (20; 64; 72; 87; 96) being provided for adjusting a distance between the channel body (14; 90) and a substrate and/or for adjusting the distance between the channel body (14; 90) and the frame (16; 62), the at least one spacer (20; 64; 72; 87; 96) being formed with infinite height adjustment.

6 Claims, 5 Drawing Sheets

(56) References Cited

U.S. PATENT DOCUMENTS

Figure 1:
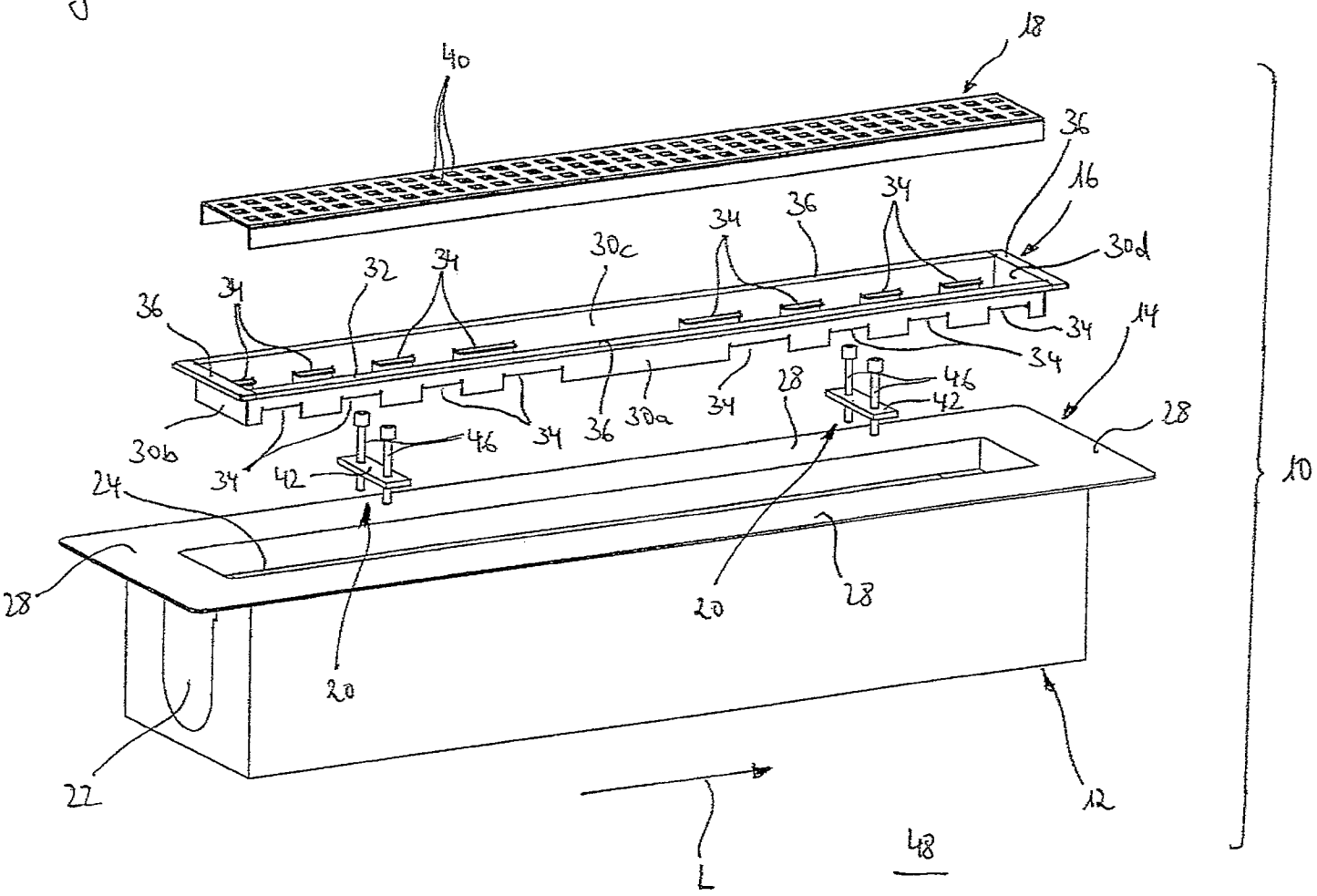

| | | | |
|---|---|---|---|
| 3,225,545 | A | 12/1965 | Flegel |
| 3,246,582 | A | 4/1966 | Wade et al. |
| 3,418,669 | A | 12/1968 | Maxwell |
| 3,774,765 | A | 11/1973 | Kane et al. |
| 4,235,008 | A | 11/1980 | Meredith |
| 4,462,123 | A | 7/1984 | Morris et al. |
| 4,490,067 | A | 12/1984 | Dahowski |
| 4,498,807 | A | 2/1985 | Kirkpatrick et al. |
| 4,515,498 | A | 5/1985 | Thomann et al. |
| 4,553,874 | A | 11/1985 | Thomann et al. |
| RE32,248 | E | 9/1986 | Blecher |
| 4,621,939 | A | 11/1986 | Thomann et al. |
| 4,630,962 | A | 12/1986 | Thomann et al. |
| 4,630,966 | A | 12/1986 | Karbstein |
| 4,640,643 | A | 2/1987 | Williams |
| 4,699,544 | A | 10/1987 | Karbstein |
| 4,751,945 | A | 6/1988 | Williams |
| 4,815,888 | A | 3/1989 | Stegmeier |
| 4,844,655 | A | 7/1989 | Aleshire |
| 4,883,590 | A | 11/1989 | Papp |
| 4,940,359 | A | 7/1990 | Van Duyn et al. |
| RE33,439 | E | 11/1990 | Thomann et al. |
| 4,993,877 | A | 2/1991 | Beamer |
| 4,993,878 | A | 2/1991 | Beamer |
| 5,000,621 | A | 3/1991 | Beamer |
| 5,066,165 | A | 11/1991 | Wofford et al. |
| 5,154,024 | A | 10/1992 | Noel |
| 5,181,793 | A | 1/1993 | Dekel |
| 5,213,438 | A | 5/1993 | Barenwald |
| 5,226,748 | A | 7/1993 | Barenwald et al. |
| 5,256,000 | A | 10/1993 | Beamer |
| 5,281,051 | A | 1/1994 | Stegall |
| 5,281,052 | A | 1/1994 | Beamer |
| 5,340,234 | A | 8/1994 | Rossi |
| 5,372,457 | A | 12/1994 | Rante |
| 5,372,715 | A | 12/1994 | Maggard et al. |
| 5,399,047 | A | 3/1995 | Stegall |
| 5,443,327 | A | 8/1995 | Akkala et al. |
| 5,462,383 | A | 10/1995 | Van 'T Veer |
| 5,478,169 | A | 12/1995 | Stegall |
| 5,522,675 | A | 6/1996 | Gunter |
| 5,529,436 | A | 6/1996 | Meyers |
| 5,538,361 | A | 7/1996 | Beamer |
| 5,568,995 | A | 10/1996 | Beamer |
| 5,573,350 | A | 11/1996 | Stegall |
| 5,573,351 | A | 11/1996 | Beamer |
| 5,613,804 | A | 3/1997 | Beamer |
| 5,647,689 | A | 7/1997 | Gunter |
| 5,647,692 | A | 7/1997 | Gunter |
| 5,653,553 | A | 8/1997 | Gunter |
| 5,702,204 | A | 12/1997 | Gunter |
| 5,718,537 | A | 2/1998 | Becker et al. |
| 5,729,937 | A | 3/1998 | Mantelli |
| 5,735,637 | A | 4/1998 | Gunter |
| 5,735,638 | A | 4/1998 | Beamer |
| 5,779,393 | A | 7/1998 | Gunter |
| 5,803,662 | A | 9/1998 | Gunter |
| 5,853,265 | A | 12/1998 | Gunter |
| 5,890,839 | A | 4/1999 | Gunter |
| 5,971,662 | A | 10/1999 | Becker et al. |
| 6,000,881 | A | 12/1999 | Becker et al. |
| 6,004,068 | A | 12/1999 | Hosley |
| 6,027,283 | A | 2/2000 | Schweinberg et al. |
| 6,113,311 | A | 9/2000 | Becker et al. |
| 6,129,838 | A | 10/2000 | Millner |
| 6,170,095 | B1 | 1/2001 | Zars |
| 6,220,784 | B1 | 4/2001 | Bricker |
| 6,230,468 | B1 | 5/2001 | Klaus |
| 6,443,656 | B1 | 9/2002 | Gunter |
| 6,595,720 | B2 | 7/2003 | Humphries et al. |
| 6,612,780 | B2 | 9/2003 | Dahowski et al. |
| 6,688,806 | B2 | 2/2004 | Kuan |
| 6,755,966 | B1 | 6/2004 | Reed |
| 6,792,723 | B2 | 9/2004 | Stegmeier, Sr. et al. |
| 6,802,962 | B1 | 10/2004 | Browne, III et al. |
| 6,908,256 | B1 | 6/2005 | Humphries et al. |
| 6,942,419 | B2 | 9/2005 | Knak et al. |
| 7,125,506 | B2 | 10/2006 | Humphries et al. |
| 7,246,472 | B2 | 7/2007 | Nielsen |
| 7,413,372 | B2 | 8/2008 | Meyers |
| 7,507,054 | B2 | 3/2009 | Fithian et al. |
| 7,588,392 | B2 | 9/2009 | Wroblewski et al. |
| 7,784,242 | B2 | 8/2010 | Warnecke |
| 7,794,176 | B2 | 9/2010 | Musser |
| 7,862,729 | B2 | 1/2011 | Stetson |
| 7,921,532 | B2 | 4/2011 | Heaton |
| 7,997,038 | B2 | 8/2011 | Warnecke et al. |
| 8,043,497 | B2 | 10/2011 | Silverstein et al. |
| 8,096,002 | B2 | 1/2012 | Stimpson et al. |
| 8,146,308 | B2 | 4/2012 | Warnecke et al. |
| 8,239,974 | B2 | 8/2012 | Erlebach |
| 8,474,068 | B2 | 7/2013 | Kik, Sr. et al. |
| 8,486,260 | B2 | 7/2013 | Tripodi et al. |
| 8,505,131 | B2 | 8/2013 | Doolittle et al. |
| 8,661,642 | B2 | 3/2014 | Heaton |
| 8,826,613 | B1 | 9/2014 | Chrien |
| 8,959,858 | B1 | 2/2015 | Francisco |
| 8,967,190 | B2 | 3/2015 | Keizers |
| 9,127,446 | B2 * | 9/2015 | Schlueter ..... E03F 5/04 |
| 2005/0166315 | A1 | 8/2005 | Warnecke et al. |
| 2006/0239773 | A1 | 10/2006 | Meyers |
| 2006/0242913 | A1 | 11/2006 | Zhou |
| 2007/0209109 | A1 | 9/2007 | Meyers |
| 2008/0025798 | A1 | 1/2008 | Humphries et al. |
| 2008/0277324 | A1 | 11/2008 | Meyers |
| 2008/0308476 | A1 | 12/2008 | Silverstein et al. |
| 2009/0199382 | A1 | 8/2009 | Heaton |
| 2010/0235982 | A1 | 9/2010 | Stimpson et al. |
| 2010/0288685 | A1 | 11/2010 | Meyers |
| 2010/0320130 | A1 | 12/2010 | Meyers |
| 2011/0023978 | A1 | 2/2011 | Keizers |
| 2011/0154634 | A1 | 6/2011 | Heaton |
| 2011/0162137 | A1 | 7/2011 | Kik, Sr. |
| 2011/0203979 | A1 * | 8/2011 | Schlueter ..... E03F 5/04 210/164 |
| 2012/0036697 | A1 | 2/2012 | Cook |
| 2012/0037553 | A1 | 2/2012 | Silverstein et al. |
| 2012/0110827 | A1 | 5/2012 | Doolittle et al. |
| 2012/0199216 | A1 | 8/2012 | Schramer |
| 2014/0131996 | A1 | 5/2014 | Murphy |
| 2015/0040500 | A1 | 2/2015 | Francisco |
| 2015/0330068 | A1 * | 11/2015 | Schlueter ..... E03F 5/04 210/163 |

FOREIGN PATENT DOCUMENTS

| | | | |
|---|---|---|---|
| EP | 0 460 686 | A1 | 12/1991 |
| EP | 0 802 287 | A2 | 10/1997 |
| EP | 1 818 464 | A1 | 8/2007 |
| EP | 1 961 879 | A1 | 8/2008 |
| WO | 2009/091245 | A1 | 7/2009 |

OTHER PUBLICATIONS

English translation of the International Preliminary Report on Patentability and Written Opinion of the International Searching Authority in corresponding PCT application PCT/EP2011/052720, Mailed on Sep. 7, 2012.

* cited by examiner

FLOOR DRAIN

CROSS REFERENCE TO RELATED APPLICATIONS

This application is a divisional of and Applicant claims priority under 35 U.S.C. §§120 and 121 of U.S. application Ser. No. 12/932,301 filed on Feb. 23, 2011, which claims priority under 35 U.S.C. §119 from German Patent Application No. 20 2010 002 763.2 filed on Feb. 24, 2010, the disclosures of each of which are hereby incorporated by reference. A certified copy of priority German Patent Application No. 20 2010 002 763.2 is contained in parent U.S. application Ser. No. 12/932,301.

The present invention relates to a floor drain comprising a channel body defining a drain channel and having a drain opening, a frame defining a receiving opening which can be inserted at least partially into the drain channel and a cover that can be inserted into the receiving opening of the frame, in particular in the form of a grate, at least one spacer being provided for adjusting a distance between the channel body and a substrate and/or for adjusting the distance between the channel body and the frame.

This type of floor drain, which is used in particular for the construction of walk-in showers, is disclosed, for example, in EP-A-1 818 464. This floor drain comprises a channel body which defines a drain channel and is provided with a drain opening. A drain pipe for discharging the waste water can be connected to the drain opening. Furthermore the floor drain comprises a frame defining a receiving opening that can be inserted at least partially into the drain channel of the channel body and a cover that can be inserted into the receiving opening of the frame which is in the form of a grate. When fitting the floor drain the channel body is first of all provided with two foot holders on its lower side and positioned on the substrate. The foot holders are height-adjustable so that the distance between the channel body and the substrate can be set. Then the drain pipe is connected to the drain opening of the channel body. In a further fitting step the frame is inserted into the drain channel of the frame body. Fixed in advance beneath a frame flange bordering the receiving opening of the frame, spaced apart from one another by predetermined distances, are block-like spacers which come to rest on a channel body flange bordering the drain channel of the channel body. These spacers serve to adjust the distance between the channel body and the frame such that the upper side of the frame ends essentially flush with the upper side of the floor covering which is subsequently to be laid adjacent to the frame. In order to be able to allow for floor coverings with different thicknesses spacers with different heights are provided which can be used as one chooses. In a further step the floor covering is laid around the frame of the floor drain. Then the cover is inserted into the frame, and this completes the fitting of the floor drain.

It is a disadvantage of the floor drain described in EP-A-1 818 464 that spacers with different heights must be provided in order to allow for floor coverings with different thicknesses, and this leads to a large number of spacers. Accordingly, construction of the floor drain is expensive. Furthermore, the adjustment of the distance between the channel body and the frame for aligning the frame in relation to the adjacent floor covering is very time consuming and expensive. Moreover, the spacers have to remain in the structure after fitting the floor drain, and so reuse of the spacers is ruled out.

Proceeding from this prior art it is an object of the present invention to provide a floor drain of the type specified at the start which is simple and inexpensive to construct and with which the adjustment of the distance between the channel body and the frame and/or the adjustment of the distance between the channel body and a substrate is not time-consuming.

In order to achieve this object the present invention provides a floor drain of the type specified at the start with which the at least one spacer is formed with infinite height adjustment. One can therefore dispense with spacers with different heights, and this contributes to a reduction in cost. Due to the infinite height adjustment of the spacers one can moreover adjust the distance between the channel body and the frame and/or the distance between the channel body and a substrate very precisely.

Preferably, at least one spacer for adjusting the distance between the channel body and the frame is formed and dimensioned such that it engages with the side walls defining the receiving opening of the frame.

With one embodiment of the present invention at least one spacer for adjusting the distance between the channel body and the frame has a plate element which is provided with at least one threaded bore hole through which an adjusting screw extends. With this embodiment the spacer is positioned such that its plate element engages beneath the frame, whereas the at least one adjusting screw rests on the bottom of the drain channel. Height adjustment of the frame relative to the channel body can then take place easily by turning the adjusting screw.

Alternatively or in addition, in order to adjust the distance between the channel body and the frame, at least one spacer preferably has an adjusting screw which extends through a bore hole formed in the frame, in particular through a threaded bore hole. With this embodiment of the spacer a particularly simple and inexpensive construction is achieved.

Preferably, at least one spacer for adjusting the distance between the channel body and the frame is designed such that it can be removed through the receiving opening of the frame after fitting. Accordingly, the spacers can be reused after fitting the floor drain, and so one or more spacers do not have to be included with every floor drain. Construction of the floor drain is accordingly inexpensive. Furthermore, the spacers do not form a troublesome hindrance when cleaning the drain channel. Moreover, the spacers can not hinder the installation of further components, such as for example the fitting of the cover, or the laying of the floor covering material.

According to one embodiment of the present invention at least one spacer for adjusting the distance between the channel body and the frame is designed such that it engages with a frame flange surrounding the receiving opening of the frame. When fitting, in this case one must ensure that the spacer is not fastened when the frame flange is under-filled with fixing mortar, and so the spacer can be removed again after the fixing mortar has hardened to such an extent that it is can bear weight and can be reused.

Preferably the spacer has at least one lower element engaging beneath the frame flange and provided with a section projecting to the side from the frame flange, an upper element engaging over the frame flange and provided with a section projecting to the side from the frame flange, and at least one adjusting screw which extends through bore holes aligned with one another respectively provided in the sections of the elements projecting to the side from the frame flange, at least one of which is preferably in the form of a threaded bore hole.

According to one particular embodiment the spacer comprises a single upper element that engages over two opposing frame flange sections, two lower elements that respectively engage beneath one of the opposing frame flange sections, and at least two adjusting screws.

Preferably the frame has projections protruding into the receiving opening which can in particular be formed by punched-out and bent sections of the frame, by means of which a one-part and inexpensive construction is produced. The projections can serge as a support for the cover so that they automatically align the upper side of the cover in relation to the upper side of the frame. Alternatively or in addition, at least one spacer for adjusting the distance between the channel body and the frame can engage with the projections and/or bore holes, in particular threaded bore holes, for receiving an adjusting screw can at least partially be provided on the projections.

Preferably at least one spacer for adjusting the distance between the channel body and a substrate is designed such that it engages with a channel body flange. Accordingly an adjustment of the distance between the channel body and a substrate can take place if the channel body is positioned directly on the substrate when fitting the floor drain.

According to one embodiment of the present invention at least one spacer for adjusting the distance between the channel body and a substrate has an adjusting screw which extends through a bore hole formed in the channel body flange, in particular through a threaded bore hole. In this way a very simple and inexpensive construction is achieved.

Alternatively or in addition at least one spacer for adjusting the distance between the channel body and a substrate can have at least one lower element engaging beneath the channel body flange and provided with a section projecting to the side from the channel body flange, an upper element engaging over the channel body flange and provided with a section projecting to the side from the channel body flange, and at least one adjusting screw which extends through bore holes aligned with one another and respectively provided in the sections of the elements projecting to the side from the channel body flange, at least one of which is preferably in the form of a threaded bore hole.

According to one embodiment of the present invention the spacer comprises a single upper element that engages over two opposing frame flange sections, two lower elements that respectively engage beneath one of the opposing frame flange sections, and at least two adjusting screws.

Furthermore, the present invention provides a method for fitting a floor drain, in particular a floor drain of the type described above, wherein for adjusting a distance between a channel body and a substrate and/or for adjusting the distance between a channel body and a frame at least one infinitely height-adjustable spacer is used that can preferably be removed after fitting and be reused.

Figure 2:
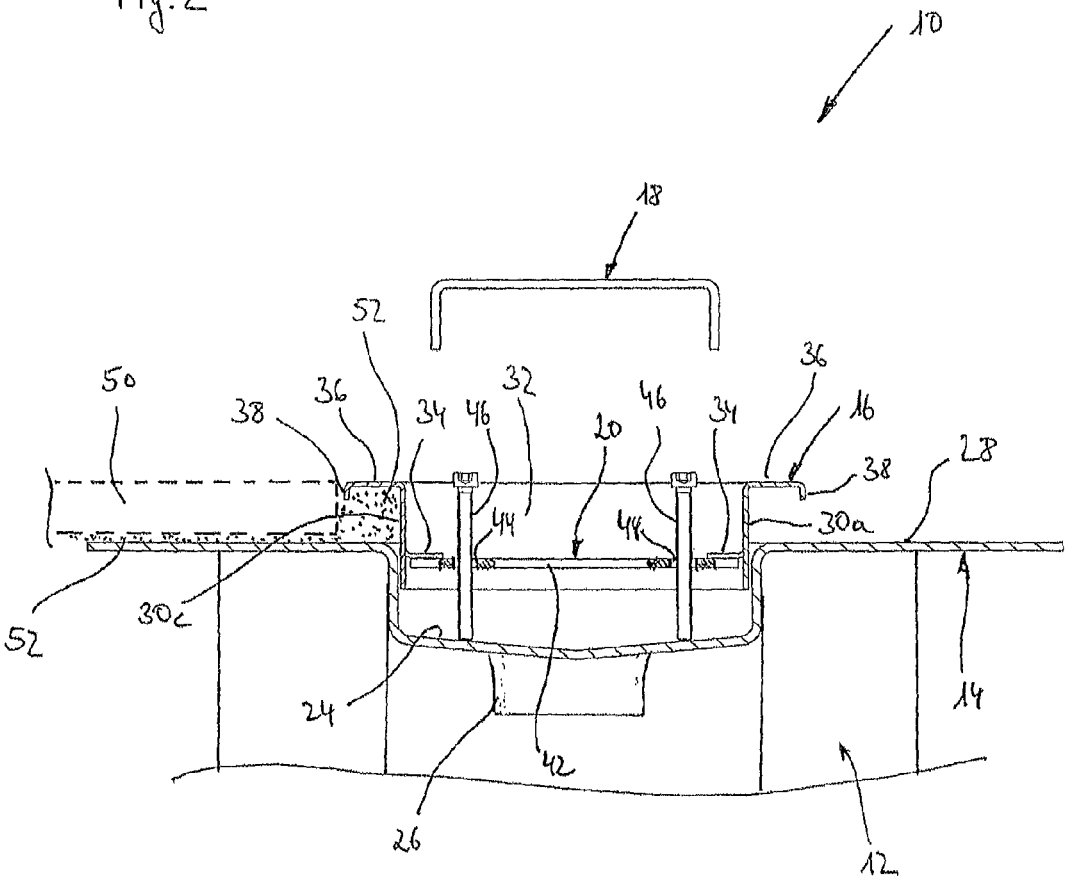
Figure 3:
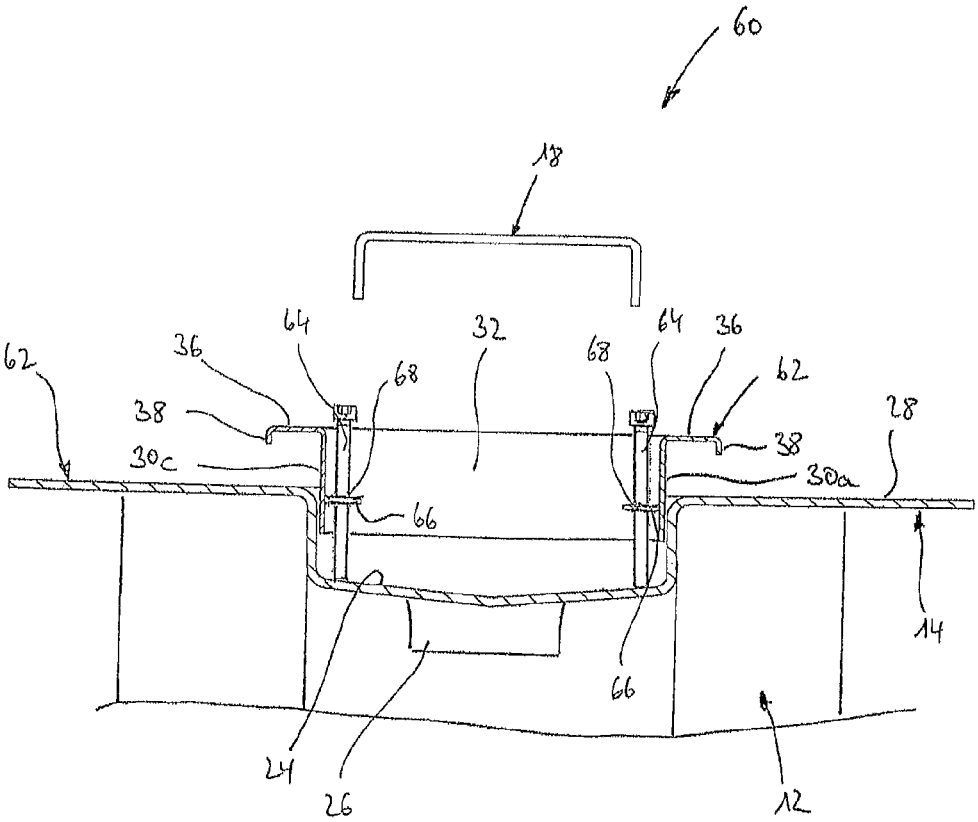
Figure 4:
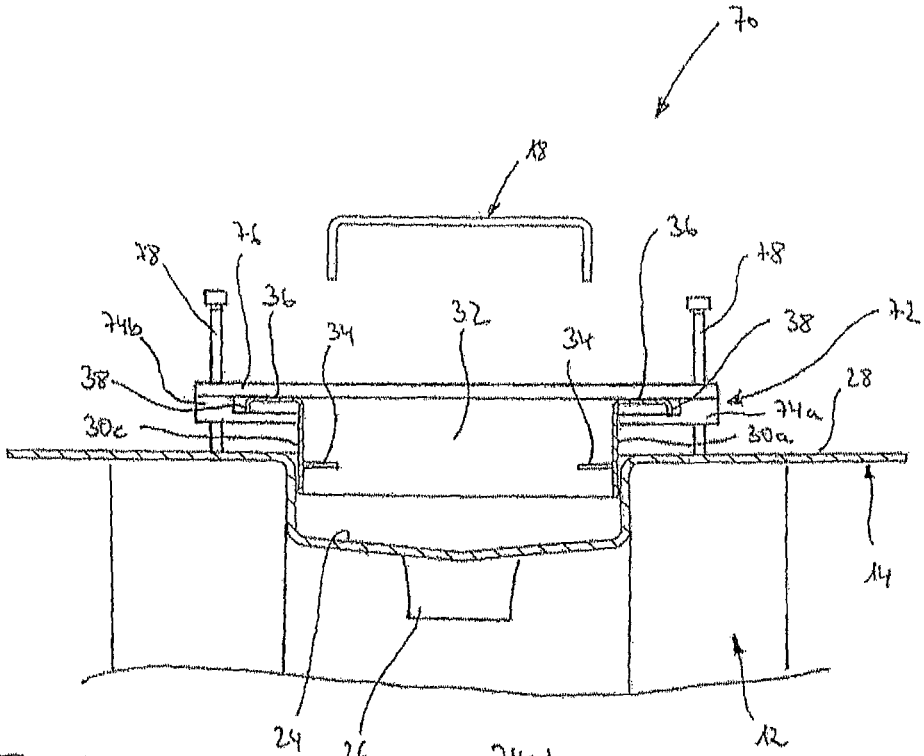
Figure 5:
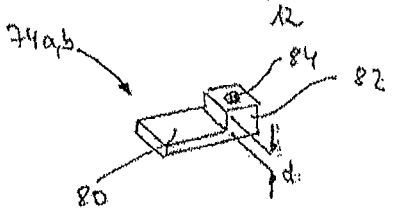
Figure 6:
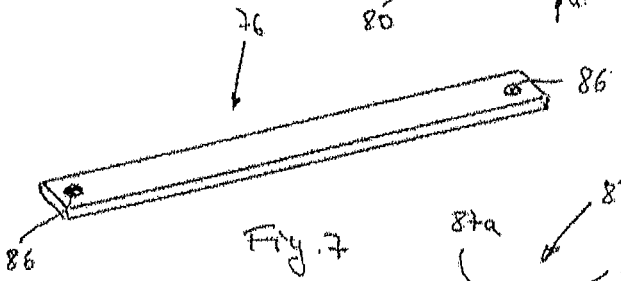
Figure 7:
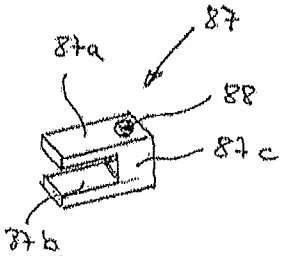
Figure 8:
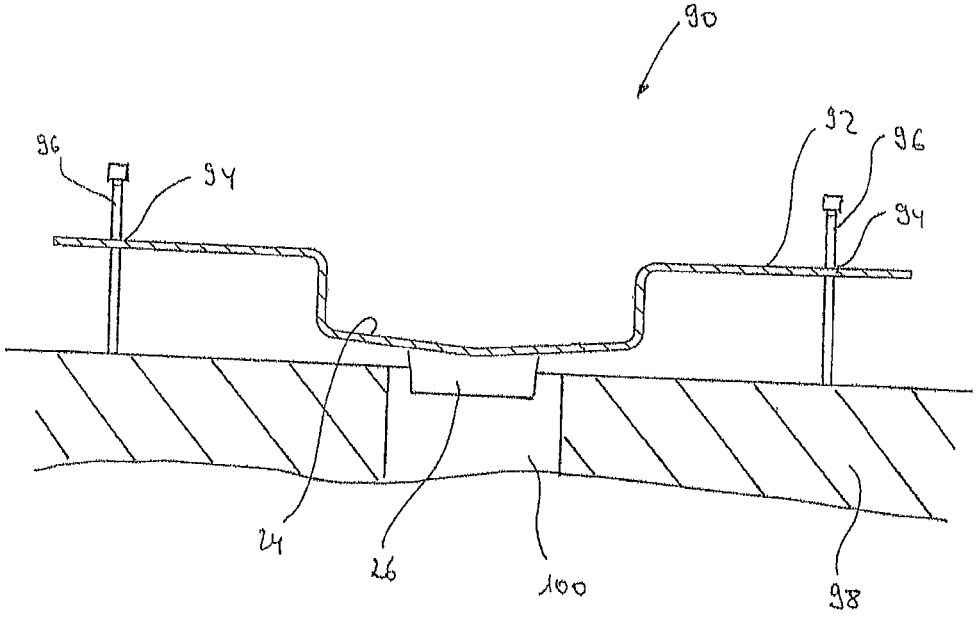

Further features and advantages of the present invention become clear by means of the following description of preferred embodiments of floor drains according to the invention with reference to the attached drawings. The latter show as follows:

FIG. 1 a perspective exploded view of a floor drain according to a first embodiment of the present invention;

FIG. 2 a cross-sectional view of the floor drain shown in FIG. 1;

FIG. 3 a cross-sectional view of a floor drain according to a second embodiment of the present invention;

FIG. 4 a cross-sectional view of a floor drain according to a third embodiment of the present invention;

FIG. 5 a perspective view of an element of a spacer of the floor drain shown in FIG. 4;

FIG. 6 a perspective view of a further element of a spacer of the floor drain shown in FIG. 4, and FIG. 7 a perspective view of an alternative spacer, FIG. 8 a cross-sectional view of a channel body of a floor drain according to a fourth embodiment of the present invention.

FIGS. 1 and 2 show a floor drain 10 according to a first embodiment of the present invention that is used in the construction of walk-in showers. The floor drain 10 comprises a base body 12, a channel body 14, a frame 16, a cover 18 and two identical spacers 20.

The base body 12 is an elongate and substantially quadrangular styrofoam block which is provided in its longitudinal direction L with a recess 22 in the form of a groove and open to the top. The recess 22 serves to accommodate a drain pipe and is formed in its upper region such that it accommodates the channel body 14 substantially with form fit.

The channel body 14 is produced from sheet metal, in particular from stainless steel or aluminium sheet. Alternatively it can be made of plastic. It defines a drain channel 24 provided with a drain opening 26 to which a drain pipe (not shown) can be connected. The drain channel 24 is surrounded by a channel body flange 28 the lower side of which in the fitted state of the floor drain 10 lies on the upper side of the base body 12.

The frame 16 is also produced from sheet metal, in particular from stainless steel or aluminium sheet. Alternatively, it can also be made of plastic. It has side walls 30*a*, 30*b*, 30*c* and 30*d* arranged like a frame and extending substantially/vertically which define a receiving opening 32. Provided on the opposing side walls 30*a* and 30*c* of the frame 16 are projections 34 protruding into the receiving opening 32 which are in the form of punched-out and bent sections of the frame 16. On its upper side the frame 16 is provided with a frame flange 36 which surrounds the receiving opening 32 like a frame. The frame flange 36 has on its free end a downwardly bent frame flange section 38.

The cover 18 is a substantially U-shaped profile made of plastic or sheet metal, in particular noble metal or aluminium sheet, which is provided on its upper side with a plurality of passage holes 40 to form a grate. Alternatively the cover can also be made without any passage holes 40. In this case the cover must be somewhat narrower in form and be fixed to the side so that side drain slots are produced.

According to a further embodiment the cover can also be in the form of a substantially U-shaped profile that in the intended positioned state is open to the top so that a floor covering material visible from the outside can be accommodated in the profile, for example in the form of tiles or the like.

The spacers 20 respectively have a substantially rectangular plate element 42 produced from wood, plastic or metal which is provided with two threaded bore holes 44 through which an adjusting screw 46 respectively extends. They serve to adjust the distance between the channel body 14 and the frame 16, as will be described in greater detail in the following.

In order to fit the floor drain 10, in a first step the base body 12 with the channel body 14 accommodated in the latter and connected to a drain pipe is positioned on a substrate 48. An incline board (not shown) is then placed on the base body 12, and this defines an incline in the direction of the floor drain 10. Alternatively, instead of an incline board screed can also be used. In a further step the frame 16 is positioned on the channel body 14 such that its side walls 30*a, b, c, d* are partially inserted into the drain channel 24 of the channel body 14. The two spacers 20 are positioned a distance apart from one another here so that the free ends of their plate elements 42 engage beneath corresponding projections 34 of the frame 16, as shown in FIG. 2. By turning the adjusting screws 46 which are supported on the bottom of the drain channel 24 of the channel body 14 the distance between the channel body 14 and the frame 16 can be increased or decreased as one chooses in order to match the upper side of the frame 16, which is defined by the frame flange 36, to the height or to the upper side of the floor covering subsequently to be laid. The floor covering, for example in the form of tiles 50 shown by dashed lines in FIG. 2 can now be laid adjacent to the frame flange 36 of the frame 16. Here the tile adhesive 52 underfills the cavity between the channel body flange 28 and the frame flange 36, the downwardly bent frame flange section 38 serving as clamping means.

After the tile adhesive has hardened to such an extent that it can bear weight, the adjusting screws 46 of the spacers 20 are loosened, whereupon the spacers 20 can be removed through the receiving opening 32 of the frame 16.

In a final step the cover 18 is placed on the projections 34 protruding into the receiving opening 32 of the frame 16. The upper side of the cover 18 is thus automatically aligned in relation to the upper side of the frame 16 defined by the frame flange 36. The fitting of the floor drain 10 is now complete.

The floor drain 10 described above is advantageous in that after adjusting the distance between the channel body 14 and the frame 16 the spacers 20 can be removed again through the receiving opening 32 of the frame 16 so that the spacers 20 can be used a number of times. Moreover, due to their design the spacers 20 enable infinite adjustment of the distance, and so it is not necessary to provide spacers of different heights. Furthermore, two spacers 20 are normally sufficient in order to adjust the distance of the frame 16 in relation to the channel body 14 while fitting the floor drain 10. Furthermore, the projections 34 of the frame 16 protruding into the receiving opening 32 and which first and foremost serve as a support for the cover 18 are used at the same time as an engagement point for the spacers 20. Accordingly, the frame 16 does not have to be formed with additional engagement points for the spacers 20.

FIG. 3 shows a floor drain 60 according to a second embodiment of the present invention. The construction of the floor drain 60 corresponds to a large extent to that of the floor drain 10, and so for the sake of simplicity the same components are identified by the same reference numbers and are not described again in the following.

The floor drain 60 only differs from the floor drain 10 with regard to the design of the frame 62 and the spacers 64.

The frame 62 is produced from sheet metal, in particular from stainless steel or aluminium sheet. Alternatively it can also be made of plastic. It has substantially vertically extending side walls 30*a*, 30*b*, 30*c* and 30*d* arranged like a frame and which define a receiving opening 32. Provided on the opposing side walls 30*a* and 30*c* of the frame 16 are projections 66 protruding into the receiving opening 32 which are in the form of punched-out and bent sections of the frame 62. The projections 66 comprise at least partially a respective bore hole 68 which is in the form of a threaded bore hole. On its upper side the frame 62 is provided with a frame flange 36 which surrounds the receiving opening 32 like a frame. The frame flange 36 has on its free end a downwardly bent frame flange section 38.

The spacers 64 of the floor drain 60 according to the second embodiment of the present invention are adjusting screws which can be screwed into the threaded bore holes 68 of the projections 66 of the frame 62.

In order to fit the floor drain 60, in a first step the base body 12 is positioned with the channel body 14 accommodated in the latter and connected to a drain pipe on a substrate 48. An incline board (not shown) is then placed on the base body 12, and this defines an incline in the direction of the floor drain 10. Alternatively, instead of an incline board screed can also be used. In a further step the frame 62 is positioned on the channel body 14 such that its side walls 30*a, b, c, d* are partially inserted into the drain channel 24 of the channel body 14. Then the spacers 64 in the form of adjusting screws are screwed into the bore holes 68 of the projections 66 of the frame 62 so, that they are supported on the bottom of the drain channel 24 of the channel body 14. By moving the spacers 64 the distance between the channel body 14 and the frame 62 can now be increased or decreased as one chooses in order to match the upper side of the frame 62 which is defined by the frame flange 36 to the height and to the upper side of the floor covering subsequently to be laid. The floor covering, for example in the form of tiles (not shown), can now be laid adjacent to the frame flange 36 of the frame 62. Here—similarly to the illustration in FIG. 2—the tile adhesive underfills the cavity between the channel body flange 28 and the frame flange 36, the downwardly bent frame flange section 38 serving as clamping means.

After the tile adhesive has hardened to such an extent that it can bear weight the spacers 64 in the form of adjusting screws are loosened and removed through the receiving opening 32 of the frame 62.

In a final step the cover 18 is placed on the projections 66 protruding into the receiving opening 32 of the frame 62. Here the upper side of the cover 18 is automatically aligned in relation to the upper side of the frame 62 defined by the frame flange 36. The fitting of the floor drain 60 is now complete.

The floor drain 60 described above is characterised in particular by the simple and inexpensive design of the spacers 64. Furthermore, after adjusting the distance between the channel body 14 and the frame 62 the spacers 64 can be removed again through the receiving opening 32 of the frame 62, and so the spacers 64 can be used a number of times. Moreover, the spacers 64 in the form of adjusting screws enable infinite adjustment of the distance, and so it is not necessary to provide spacers of different heights. Furthermore, four spacers 64 are normally sufficient for making adjustments to the distance of the frame 62 in relation to the channel body 14 while fitting the floor drain 60.

FIGS. 4 to 6 show a floor drain 70 according to a third embodiment of the present invention and illustrations of components of the latter. The construction of the floor drain 70 corresponds to a large extent to that of the floor drain 10, and so the same components are provided with the same reference numbers and will not be described again in the following.

The floor drain 70 only differs from the floor drain 10 in relation to the design of its spacers 72.

The spacers 72 of the floor drain 70 according to the third embodiment of the present invention are designed such that they engage with the frame flange 36 surrounding the receiving opening 32 of the frame 16. For this purpose every spacer 72 has two lower elements 74*a* and 74*b* engaging beneath the frame flange 36 in the intended positioned state, an upper element 76 engaging over the frame flange 36 and two adjusting screws 78.

As viewed in the cross-section, each of the identically formed lower elements 74*a* and 74*b* is substantially L-shaped in design and comprises a first section 80 engaging beneath the frame flange 36 in the intended positioned state and a second section 82 projecting to the side from the frame flange 36 in the intended positioned state, a height offset d between the first section 80 and the second section 82 corresponding approximately to the height of the frame flange section 38. The second section 82 is provided with a through bore hole 84 which is in the form of a threaded bore hole.

The upper element 76 is in the form of a narrow plate element the length of which is chosen such that it engages over opposing frame flange sections. Close to the free ends of the upper element 76 a through bore hole 86 in the form of a threaded bore hole is respectively provided. The lower elements 74*a, b* and the upper element 76 are dimensioned such that in the intended positioned state their through bore holes 84 and 86 are aligned with one another. In this state the adjusting screws 78 can be screwed into the through bore holes 84 and 86.

In order to fit the floor drain 70, in a first step the base body 12 with the channel body 14 accommodated in the latter and connected to a drain pipe is positioned on a substrate 48. An incline board (not shown) is than placed on the base body 12, and this defines an incline in the direction of the floor drain 70. Alternatively, instead of an incline board screed can also be used. In a further step the frame 16 is positioned on the channel body 14 such that its side walls 30*a, b, c, d* are partially inserted into the drain channel 24 of the channel body 14. Spacers 72 are then fitted such that the two lower elements 74*a* and 74*b* engage beneath opposing frame flange sections, the lower elements 74*a* and 74*b* being held in position by the upper element 76 engaging over the corresponding frame flange sections and the two adjusting screws 78. The adjusting screws 78 are supported here on the upper side of the channel body flange 28. By turning the adjusting screws 78 the space between the channel body 14 and the frame 16 can be increased or decreased as one chooses in order to match the upper side of the frame 16 which is defined by the frame flange 36 to the height and to the upper side of the floor covering subsequently to be laid. The cavity between the channel body flange 28 and the frame flange 36 can now be underfilled adjacent to the spacers 72 with tile adhesive or fixing mortar.

After the tile adhesive or fixing mortar has hardened to such an extent that it can bear weight, the adjusting screws 78 can be loosened and the spacers 72 removed. The floor covering, for example in the form of tiles (not shown) can then be laid adjacent to the frame flange 36 of the frame 16. Here the regions of the cavity between the channel body flange 28 and the frame flange 36 left open previously due to the presence of the spacers 72 can now be underfilled with tile adhesive or fixing mortar.

In a final step the cover 18 is placed on the projections 34 protruding into the receiving opening 32 of the frame 16. Here the upper side of the cover 18 is automatically aligned in relation to the upper side of the frame 16 defined by the frame flange 36. The fitting of the floor drain 10 is now complete.

The floor drain 70 described above is advantageous in that after adjusting the distance between the channel body 14 and the frame 16 and after the tile adhesive or tile mortar has hardened to such an extent that it can bear weight the spacers 72 can be removed again, and so the spacers 72 can be used a number of times. Moreover, due to their design the spacers 72 enable infinite adjustment of the distance, and so it is not necessary to provide spacers 72 with different heights. Further, two spacers 72 are normally sufficient to adjust the distance of the frame 16 in relation to the channel body while fitting the floor drain 70.

Instead of the spacer disc 72 shown in FIGS. 4 to 6, substantially U-shaped spacers 87 as shown in FIG. 7 can also alternatively be used. Each spacer 87 comprises two preferably elastically formed arms 87*a* and 87*b* arranged substantially parallel to one another which clamp the frame flange 36 between them, and a connection arm 87*c* connecting the arms 87*a* and 87*b* to one another. The connection arm 87*c* is provided with a through bore hole, preferably in the form of a threaded bore hole, in order to hold an adjusting screw 78.

FIG. 8 shows a channel body 90 of a floor drain according to a further embodiment of the present invention the construction of which corresponds to that of the floor drain 10 as regards the frame 16, the spacers 20 and the cover 18, and so these components will not be described again.

The channel body 90 resembles to a large extent the channel body 14 of the floor drain 10 according to the first embodiment, and so the same components are provided with the same reference numbers and are not described again. The channel body 90 is produced from sheet metal, in particular from stainless steel or aluminium sheet. Alternatively, it can also be made of plastic. It defines a drain channel 24 which is provided with a drain opening 26 to which a drain pipe (not shown) can be connected. The drain channel 24 is surrounded by a channel body flange 92 like a frame. The channel body flange 92 is provided with a series of through bore holes 94 which are in the form of threaded bore holes.

Moreover, spacers 96 in the form of adjusting screws are provided which can be screwed into the through bore holes 94 of the channel body flange 92.

In order to fit the channel body 90, in a first step the spacers 96 in the form of adjusting screws are screwed into the through bore holes 94 of the channel body flange 92. Then the channel body flange 92 is positioned on a substrate 98 such that the drain opening 96 is aligned with a drain 100 provided in the substrate 98. Here the spacers 96 are supported on the surface of the substrate 98. By moving the spacers 96 the distance between the channel body 90 and the substrate 98 can now be increased or decreased as one chooses in order to match the upper side of the channel body 90 which is formed by the channel body flange 92 to the height and to the upper side of the screed subsequently to be produced. When subsequently laying the screed the cavity between the channel body flange 92 and the substrate 98 is filled with screed. After the screed has hardened to such an extent that it can bear weight the spacers 96 in the form of adjusting screws can then be loosened and removed.

The frame, the floor covering and the cover can then be installed, as described above with reference to FIG. 2.

Alternatively, the through bore holes 94 formed in the channel body flange 92 can also be designed without a thread. In this case at least one nut, which is screwed onto the adjusting screw, is used in order to support the channel body flange 92.

The previously described channel body 90 is advantageous in that with the latter the distance between the channel body flange 92 and the substrate 98 can additionally be adjusted infinitely. Furthermore, the spacers can be removed after fitting the channel body 90 and be used again. Moreover, despite its adjustability the channel body 90 has a simple and correspondingly inexpensive construction.

Alternatively, in order to adjust the height between the channel body 90 and the substrate 98, instead of the spacers 96, spacers can also be used which are designed similarly to the spacers 72 shown in FIGS. 4 to 6, only that the latter engage with the channel body flange 92, and not with the frame flange section 38.

List of reference numbers

| | |
|---|---|
| 10 | floor drain |
| 12 | base body |
| 14 | channel body |
| 16 | frame |
| 18 | cover |
| 20 | spacer |
| 22 | recess |
| 24 | drain channel |
| 26 | drain opening |
| 28 | channel body flange |
| 30 a, b, c, d | side wall |
| 32 | receiving opening |
| 34 | projection |
| 36 | frame flange |
| 38 | frame flange section |
| 40 | passage hole |
| 42 | plate element |
| 44 | threaded bore hole |
| 46 | adjusting screw |
| 48 | substrate |
| 50 | tile |
| 52 | tile adhesive |
| 60 | floor drain |
| 62 | frame |
| 64 | spacer |
| 66 | projection |
| 68 | bore hole |
| 70 | floor drain |
| 72 | spacer |
| 74a, b | lower element |
| 76 | upper element |
| 78 | adjusting screw |
| 80 | first section |
| 82 | second section |
| 84 | through bore hole |
| 86 | through bore hole |
| 87 | spacer disc |
| 87a, b | arm |
| 87c | connection arm |
| 88 | through bore hole |
| 90 | channel body |
| 92 | channel body flange |
| 94 | through bore hole |
| 96 | spacer |
| 98 | substrate |
| 100 | drain |

What is claimed is:

1. A method for fitting a floor drain, the floor drain comprising:

a channel body defining a drain channel as well as a channel body flange and having a drain opening, a frame having a frame flange, the frame defining a receiving opening which can be inserted at least partially into the drain channel, a cover that can be inserted into the receiving opening of the frame, and at least one infinitely height-adjustable spacer provided for facilitating elevational adjustment of the channel body relative to the frame, wherein the method comprises:

placing the at least one infinitely height-adjustable spacer in the channel body so that the at least one infinitely height-adjustable spacer engages the frame, adjusting the at least one infinitely height-adjustable spacer to adjust a distance between the frame and the channel body to an adjusted distance, underfilling a cavity between the channel body flange and the frame flange with tile adhesive, allowing the tile adhesive to harden such that the adjusted distance is fixed, and removing the at least one infinitely height-adjustable spacer through the receiving opening after the tile adhesive has hardened.

2. The method according to claim 1, wherein the at least one infinitely height-adjustable spacer engages the side walls defining the receiving opening of the frame.

3. The method according to claim 1, wherein the at least one infinitely height-adjustable spacer has a plate element provided with at least one threaded bore hole and includes an adjusting screw extending through the at least one threaded bore hole.

4. The method according to claim 1, wherein the at least one infinitely height-adjustable spacer includes an adjusting screw which extends through a threaded bore hole formed in the frame.

5. The method according to claim 1, wherein the frame has projections protruding into the receiving opening which serve as a support for the cover and/or with which the at least one infinitely height-adjustable spacer for adjusting the distance between the channel body and the frame engages and/or on which at least partially, threaded bore holes for holding an adjusting screw are provided.

6. The method according to claim 5, wherein the projections are formed by punched-out and bent sections of the frame.

* * * * *